United States Patent [19]

Aguilar, Jr.

[11] 4,047,349

[45] Sept. 13, 1977

[54] SHEET MATERIAL ATTACHING DEVICE AND WALL ARRANGEMENT USING THIS DEVICE

[75] Inventor: Manuel Aguilar, Jr., Savannah, Ga.

[73] Assignee: Johns-Manville Corporation, Denver, Colo.

[21] Appl. No.: 686,351

[22] Filed: May 14, 1976

[51] Int. Cl.[2] ..... E04D 1/34

[52] U.S. Cl. ..... 52/551; 52/546; 52/553

[58] Field of Search ..... 52/551, 546, 548, 553

[56] References Cited

U.S. PATENT DOCUMENTS

| | | | |
|---|---|---|---|
| 978,334 | 12/1910 | Overbury | 52/551 |
| 1,593,408 | 7/1926 | Honigbaum | 52/548 |
| 1,925,939 | 9/1933 | Sherman | 52/551 |
| 1,935,636 | 11/1933 | James | 52/551 |
| 1,940,936 | 12/1933 | Black | 52/551 |
| 2,293,744 | 8/1942 | Miles | 52/553 |
| 2,877,879 | 3/1959 | Johnson | 52/546 |
| 3,724,154 | 4/1973 | Cookson | 52/553 |

FOREIGN PATENT DOCUMENTS

| | | | |
|---|---|---|---|
| 90,828 | 11/1957 | Norway | 52/546 |

OTHER PUBLICATIONS

*Sheet Metal Worker*, Jan. 1948, pp. 108, 109.

*Primary Examiner*—Price C. Faw, Jr.
*Assistant Examiner*—Henry Raduazo
*Attorney, Agent, or Firm*—Robert M. Krone; Joseph J. Kelly; Stephen C. Shear

[57] ABSTRACT

A wall arrangement is disclosed herein and includes at least one fixed support member having vertically extending front support face, at least one elongated sheet of material, for example exterior vinyl siding, and a device for attaching the sheet to the front face of the support member to support it in a vertical position. This attaching device includes a longitudinal strip which is connected to the front face of the support member and a plurality of outwardly extending, elongated support elements which are inserted through openings in the sheet material for supporting it in the vertical position just discussed.

3 Claims, 8 Drawing Figures

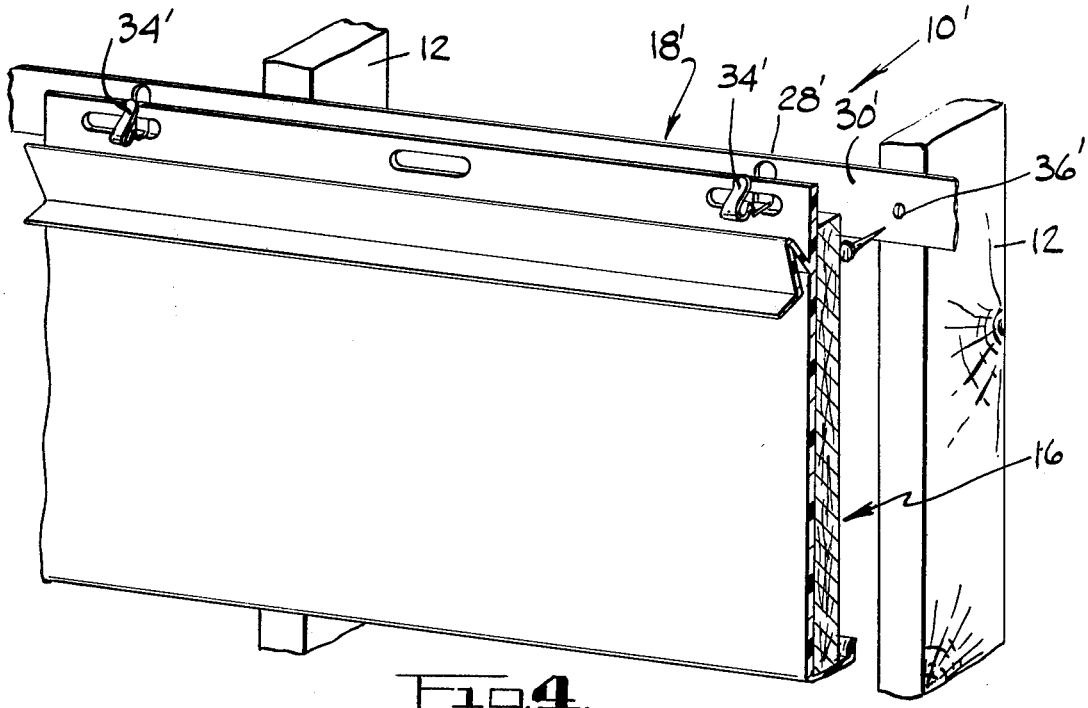
FIG. 4.
FIG. 5.
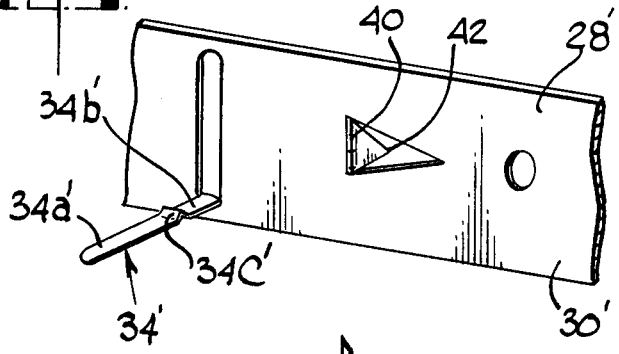
FIG. 7.
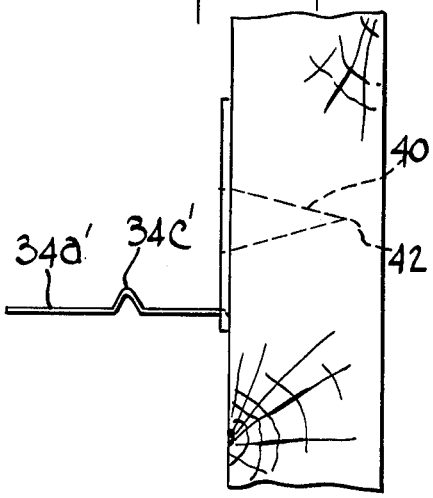
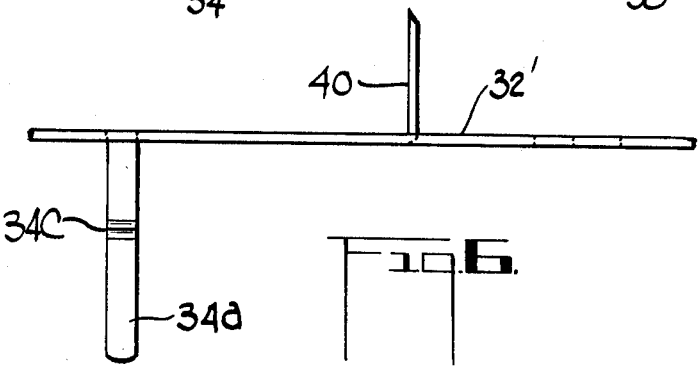
FIG. 6.

SHEET MATERIAL ATTACHING DEVICE AND WALL ARRANGEMENT USING THIS DEVICE

BACKGROUND OF THE INVENTION

The present invention relates generally to sheet material supporting arrangements and more particularly to a device for attaching sheet material to a vertically extending face of a fixed support member. While the present invention is applicable to wall structures or arrangements generally, it is particularly applicable to exterior siding structures or arrangements which utilize polyvinyl chloride (PVC) or other suitable siding material, such as aluminum.

Vinyl siding, as it is commonly referred to, has been used for a number of years as a finished exterior surface on building structures, particularly residential structures. It is typically laid up in overlapping courses starting with a lowermost course or starter course, and progressing upwards. The vinyl siding can be applied separately to an already assembled siding surface or it can be part of an overall laminate including a backer panel, for example, fiber board. In either case, the sheets of siding are attached to an existing support structure and vertically interlocked to one another in an overlapping fashion at their adjoining top and bottom edges.

One typical way in which individual siding sheets are interlocked together is by providing each sheet with a top interlocking section and a complimentary bottom interlocking section. Thus, the overlapping top and bottom edges of adjoining siding sheets in adjacent courses can be interlocked together. However, before a given sheet of siding is interlocked with the sheet above, it must be attached to the fixed support structure. There have been a number of suggested ways in which to accomplish this. One way is illustrated in, for example, U.S. Pat. No. 3,158,960 (Newton et al). There, a top edge portion of the vinyl siding of a laminated panel is provided with slots through which nails are driven to fasten the top edge of the overall panel including the vinyl siding to a fixed support structure, all in one step. In U.S. Pat. No. 3,485,004 (Mattes), the backing board itself is first nailed to the fixed support structure, at its lowermost edge, and then the backing board is covered with the exterior siding. Still another method of attachment is illustrated in U.S. Pat. No. 3,417,531 (Jones), wherein individual attachment plates are first nailed to the existing support structure and then the vinyl siding is interlocked to the attachment plates in a nailess manner. More specifically, each attachment plate includes what may be referred to as a longitudinally extending beaded channel and the vinyl siding includes what may be referred to as a beaded flange for interlocking engagement in the beaded channel.

As will be seen hereinafter, the present invention provides still another way in which to attach the vinyl siding to a fixed support structure, a way which is rapid, accurate and economical.

SUMMARY OF THE INVENTION

One object of the present invention is to provide an uncomplicated and economical device for rapidly and easily attaching and supporting sheet material, specifically vinyl (or aluminum) siding, to a vertically extending, fixed support member, specifically the exterior surface of the support member, in a reliably aligned manner.

Another object of the present invention is to provide an overall exterior wall arrangement utilizing this attaching and supporting device.

As stated above and as will be discussed more fully hereinafter, the present invention is particularly suitable for use in an overall wall arrangement, specifically an exterior wall arrangement, which includes at least one fixed support member, for example a stud or preassembled sheathing, having a vertically or substantially vertically extending front face. The arrangement also includes at least one elongated sheet of material, specifically exterior vinyl (or aluminum) siding, for attachment in a vertical position against and in front of the front face of the support member and, of course, means for attaching the sheet, to the support member in this vertical position.

In accordance with the present invention, the sheet material attaching means includes a longitudinal connecting strip which has a front longitudinally extending face and a back longitudinally extending face and which is adapted for connection with the support member such that its back face rests against the support member. The attaching means also includes a plurality of elongated support elements spaced from one another longitudinally along the front face of the strip. Each of these support elements is connected at one end with the strip and is readily adapted to extend out beyond the front face thereof. In this way, outwardly extending portions of the support elements can be inserted through openings in the sheet material to support the sheet material in a vertical position adjacent the fixed support member.

In a preferred embodiment of the present invention, the longitudinal strip is constructed of a bendable sheet metal or plastic and the support elements are integral stamped-out segments of the strip. These integral elements, prior to assembly, are substantially straight. They can be initially provided in positions extending out from their connecting strip or for convenience of shipping, they can be initially provided in position flush with the strip and subsequently bent outwardly. After the longitudinal strip has been suitably fastened to the existing support structure, these straight support elements, which by now have been bent out from the connecting strip, are inserted through associated openings in the sheet material, specifically the vinyl and/or aluminum siding, and thereafter they are bent up around the front face of the siding. For reasons to be discussed hereinafter, it is preferred that each support element includes in its surface an upwardly extending irregularity which is located a predetermined distance in front of the front face of its associated strip and which is ultimately located directly behind the front face of the sheet material.

BRIEF DESCRIPTION OF THE DRAWINGS

FIG. 4 is a perspective view of a portion of an overall exterior wall arrangement constructed in accordance with a second embodiment of the present invention.

FIG. 5 is a front perspective view of an attaching device constructed in accordance with a second embodiment of the present invention.

FIG. 6 is a side view of the device illustrated in FIG. 5.

FIG. 7 is a side elevational view of the device illustrated in FIGS. 5 and 6, however, in this figure the device is shown attached to an existing support structure.

DETAILED DESCRIPTION

Figure 1:
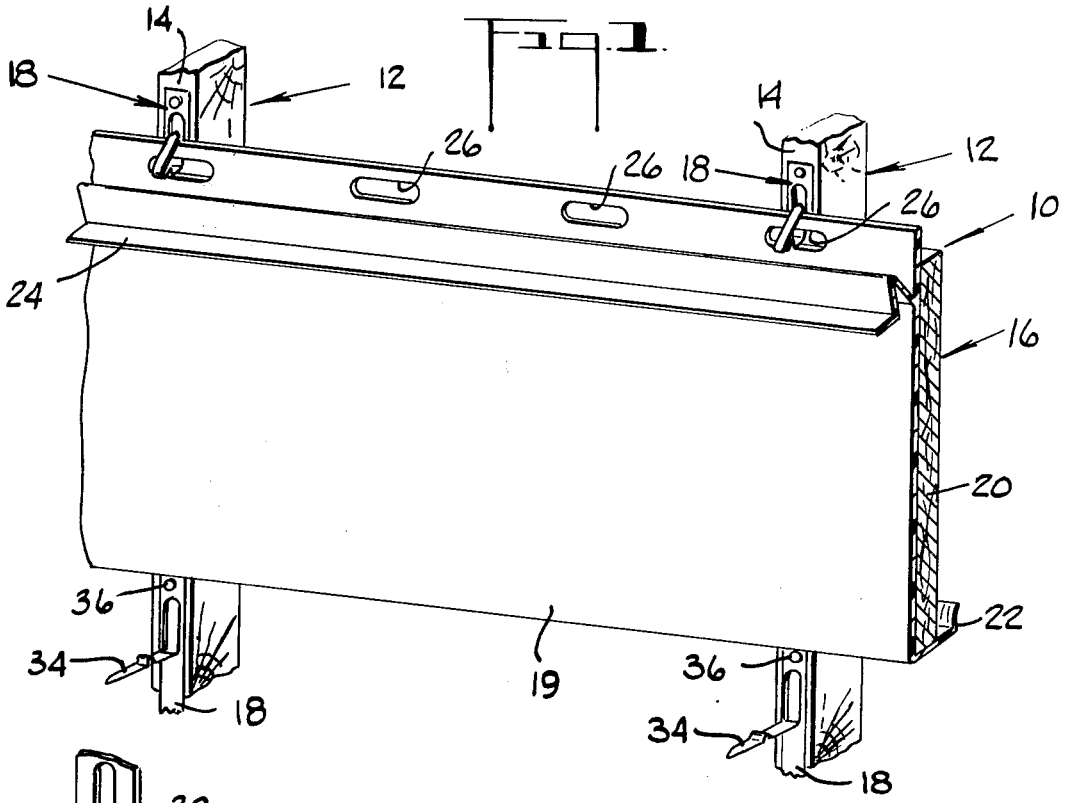
FIG. 1 is a perspective view of a portion of an overall exterior wall arrangement constructed in accordance with the present invention.

Turning to the drawings, wherein like components are designated by like reference numerals throughout the various figures, attention is specifically directed to FIG. 1 which illustrates an overall exterior wall arrangement constructed in accordance with one embodiment of the present invention and generally designated by the reference numeral 10. Arrangement 10 includes at least one but preferably a number of fixed support members 12 having vertically extending front faces 14. The arrangement also includes at least one but generally a number of elongated sheets of material, specifically exterior vinyl or aluminum siding panels, generally designated at 16, which are adapted for attachment in a vertical position against and in front of the front faces of the support members. To attach the panels in this fashion, arrangements 10 includes a number of fastening devices which are constructed in accordance with the present invention and which are generally designated by the reference numeral 18.

As illustrated in FIG. 1, fixed support members 12 are in actuality vertically and horizontally spaced support studs. The support members may, however, take the form of planar sheathing, for example fiber board, attached to the front faces of the studs. In the embodiment illustrated, however, the vinyl siding panel itself includes a backing board, i.e., its own sheathing as will be discussed below, and hence, the entire panel can be attached directly to the studs.

As seen best in FIG. 1, the panel 16 is a composite including a relatively thin sheet of vinyl siding 19 making up the face of the overall composite and a backing board 20, for example, wood fiber board, suitably laminated to the backside of the vinyl siding. Of course, the panel may consist only of the siding (without the backing) in which case support sheathing would be applied to the studs. In either case the sheet of vinyl siding itself includes a conventional interlocking flange 22 extending continuously along its bottom edge and projecting back beyond the backing board 20. The vinyl siding also includes a complimentary top interlocking flange 24 which extends the length of the siding a slight distance below its top edge and which projects out in front of the front face of the siding.

Figure 3:
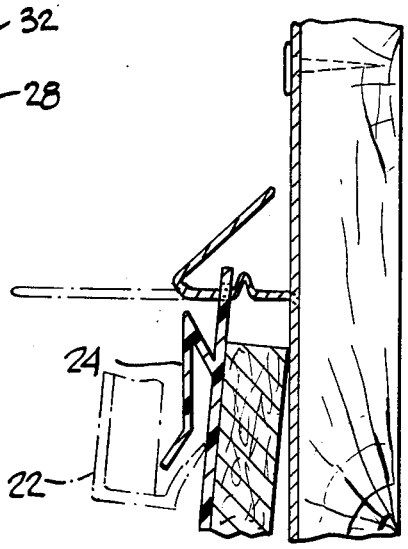
FIG. 3 is a longitudinal sectional view of a portion of the arrangement illustrated in FIG. 1, particularly illustrating how the fastening device in FIG. 2 cooperates with the other components of the overall arrangement.

As illustrated in FIG. 3, the top interlocking flange 24 is designed to engage into and interlock with a bottom interlocking flange 22 (indicated by dotted lines) in a panel in the successive course above. This particular method of interlocking adjacent panels in successive courses is conventional and does not in and of itself form part of the present invention. Hence, a detailed discussion of the particular configuration of either interlocking flange 22 or interlocking flange 24 or the method in which they interlock together will not be further discussed herein.

In the embodiment illustrated in FIG. 1, it should be noted that the uppermost edge of backing board 20 is located below the uppermost edge of vinyl siding sheet 19. Actually, the upper edge of the backing board is in alignment with interlocking flange 24 which itself is located a short distance below the top edge of the vinyl siding sheet. This upper longitudinally extending portion of sheet 19 includes a number of longitudinally spaced and longitudinally aligned slots 26 extending entirely through the sheet. These slots, which are provided for reasons to be discussed below, are preferably elongated in the longitudinal direction, also for reasons to be discussed hereinafter.

Figure 2:
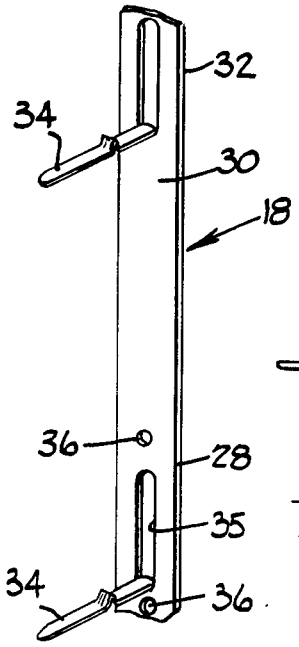
FIG. 2 is a perspective view of an attaching device which is constructed in accordance with one embodiment of the present invention and which is utilized in the overall arrangement illustrated in FIG. 1.

Turning to FIG. 2, attention is directed to one of the attaching devices 18 which, in this figure, is illustrated in its unassembled or unattached condition. As seen in FIG. 2, device 18 includes a relatively thin longitudinal strip 28 having a longitudinally extending, preferably flat, front face 30 and a similar longitudinally extending back face 32 (see FIG. 2A). Device 18 also includes a plurality of elongated support elements 34 which are spaced from one another longitudinally along the front face of the strip. Each of these elements is connected at one end with strip 28 and extends out beyond front space 30.

As will be discussed more fully hereinafter, strip 28 is suitably attached to one of the support studs 12 such that its back face 32 rests against the front face 14 of the support member. This may be accomplished by many suitable means such as nails, in which case these strips would preferably include a number of longitudinally spaced preformed nail holes, indicated at 36 in FIG. 2. With the strips fastened in this position, the support elements 34 extend out beyond the front face of the support stud. The spacing between support elements is such that vertically adjacent elements may be readily inserted in aligned slots 26 in vertically adjacent panels.

In a preferred embodiment, strip 30 is constructed of bendable sheet metal, for example, 20 mils thick and each of the support elements 34 are integral stamped-out sections of the strip (leaving slots 35 in the strips), which, when they are stamped-out are substantially straight and substantially perpendicular to surface 30. However, the stamped-out support elements could be initially maintained in the slots 35, i.e., flush with the strip, prior to assembly, so as to facilitate shipping. Moreover, the strip itself could be constructed of any suitable material so long as (1) the support elements can be connected with it, (2) it maintains the support elements fixed relative to one another, and (3) it can be attached to the support studs or sheathing.

Figure 2A:
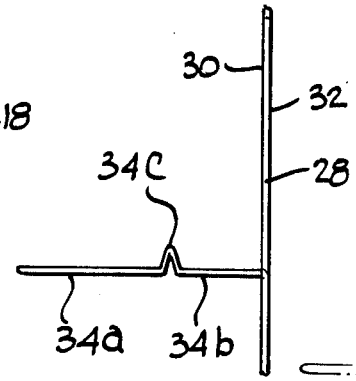
FIG. 2A is a side elevational view of the attaching device of FIG. 2.

Each of the support elements 34 preferably includes an outermost straight section 34*a*, an innermost straight section 34*b* and a vertically upwardly protruding irregularity 34*c* joining the two straight sections, as seen best in FIG. 2A. This irregularity may be an abrupt curve or bend in the support element, it may be a dent or any other suitable means to accomplish its intended purpose to be discussed below. In any event, it should be noted that this irregularity 34*c* is located a predetermined distance in front of the front face 30 of strip 28, specifically a distance slightly less than the overall thickness of siding sheet 19 and backing 20, and a predetermined distance back from the free end of straight section 34*a*.

Returning to FIG. 1 in conjunction with FIG. 3, attention is now directed to the manner in which devices 18 are used to attach panels 16 to support studs 12. As illustrated best in FIG. 1, a fastening device 18 is attached to one stud 12 such that the back face 32 of strip 28 confronts the front face 14 of the stud. As stated previously, the strip may be attached directly to the stud by means of nails driven into the stud through openings 36. The strip preferably extends approximately the entire length of stud 12 or at least the length of that portion of the stud to be covered by one or more panels 16. In this regard, where the individual fastening devices are not of sufficient length to extend the needed length of the stud, a number of fasteners may be positioned in end to end relationship. At least two but preferably all of the adjacent studs are provided with fastening devices in a similar manner. In this regard, it should be noted that the support elements 34 extending out from a given stud must be horizontally aligned with corresponding support elements extending out from the adjacent studs. Moreover, the spacing between adjacent support elements of a given attaching device is equal to the distance between slots 26 in vertically adjacent panels when the vertically adjacent panels are interlocked together. In this way, as stated previously, these vertically adjacent support elements can be readily inserted into the slots 26 of the interlocked panels.

Once the support devices are suitably fastened to support studs 12, the panels 16 are ready to be assembled that is assuming the support elements are extending out from the support strip, for example as illustrated in FIGS. 2 and 2A. As stated previously, the panels are laid up in courses starting with a lowermost course, or actually a starter course, and progressing up from this course. As best seen in FIG. 3, the top end of a given panel is brought into engagement with the support studs by inserting horizontally aligned support elements of adjacent attaching devices through horizontally aligned openings 26 in the top edge portion of the vinyl siding sheet. As indicated in FIG. 3, the portion of element 34 which is actually inserted entirely through opening 26 includes only outermost straight section **34*a*. The upwardly extending irregularity is located behind siding sheet 19 (along with section 34*b*) and serves to inhibit the panel from moving inwardly along element 34, beyond the irregularity, thereby preventing the top edge portion of the panel from pressing tightly against support members 12**.

Once the support elements and panel are positioned in this manner, the outermost end sections **34*a* of each element is bent upwards and preferably back behind the vinyl facing sheet as illustrated in both FIGS. 1 and 3. Inasmuch as the support elements are constructed of a readily bendable material, they may be bent manually. In FIG. 3 it can be seen that the bend takes place directly in front of siding sheet 19. However, because of the irregularity 34*c*, the top edge of the panel is not pressed tightly against the support member. This results in a clearance between the panel and supports so that the sheet is free to expand and contract longitudinally, i.e., so that the sheet is "longitudinally free floating". This is also why preformed openings 26** are provided and why they preferably extend somewhat longitudinally. The openings allow the vinyl siding to expand and contract while the support elements hold it against the support studs.

Once a given panel is supported to studs 12 in the manner just described, a second panel in the adjacent course above is interlocked at its bottom longitudinal edge to the top longitudinal edge of the supported panel. This is accomplished by means of complimentary flanges 22 and 24 on the respective panels. The top edge of this upper panel is, of course, fastened to the support studs in the manner described, i.e., using aligned support elements 34 in conjunction with aligned slots 26.

From the foregoing it should be readily apparent that panels 16 can be rapidly and accurately assembled so long as attaching devices 18 are properly aligned and fastened to the support members. The devices themselves can be properly aligned and fastened to the studs in a rapid and accurate fashion. For example, a chalk line can be dropped near one edge of each face 14 of the support studs and one edge of each fastening device can be aligned with the chalk line. Horizontal alignment of the support elements 34 on adjacent support studs can be accomplished by means of, for example a level or chalk line. Once a starter course is established alignment is automatic based on dimensions.

Turning to FIG. 4, attention is directed to an overall exterior arrangement 10' constructed in accordance with a second embodiment of the present invention. Arrangement 10' includes the same stud supports 12 and panels 16 but a slightly modified attaching device designated by the reference numeral 18'. This modified device, like device 18, includes a longitudinally extending strip 28' having a longitudinally extending front face 30' and a longitudinally extending back face 32' (FIG. 6). It also includes a plurality of longitudinally spaced support elements 34' which extend out from the front face in the same manner as support elements 34. Like device 18, device 18' is preferably an integral unit constructed of a bendable sheet metal and the support elements 34' are preferably stamped-out out segments of strip 28'. Of course, the strip 28', like strip 28, can be of any suitable material and shape so long as it functions in the manner intended.

However, as illustrated in FIG. 4, the strip 28' is not secured in a vertical position, but rather in a horizontal position spanning a number of adjacent support studs 12 and it is fastened to these support studs by means of, for example, nails, which are driven through openings 36'. Because the device 18' is to be horizontally mounted, the support elements 34' are stamped-out of strip 28' in a transverse direction as best illustrated in FIG. 5, as opposed to the longitudinal direction of elements 34 as illustrated in FIG. 2. Apart from this distinction, the support elements 34' are identical to support elements 34 in that they include two straight sections and an intermediate irregularity, generally designated at **34*a'* 34*b'* and 34*c'*, respectively. The support elements 34' are however spaced differently than elements 34. Specifically, the spacing between elements 34' is dependent upon the spacing between openings 36 in an individual panel 16**, which in turn are dependent upon the spacing of the support studs, and not between vertically aligned openings in vertically adjacent panels.

In addition to the foregoing, device 34' may include a number of additional stamped-out segments, one of which is indicated at 40 in FIGS. 5–7. These additional stamped-out segments are longitudinally spaced from one another along the length of strip 28', for example one at each end. As best seen in FIGS. 5 and 7, stamped-out segment 40 extends outwardly from the back surface 32' of strip 28' and tapers to a point, indicated at 42. As illustrated in FIG. 7, these segments can be driven into studs 12 to support strip 28'. If the particular material making up these segments, actually making up the entire strip, is sufficiently rigid these segments by themselves can be used to support the strip in lieu of the nails discussed above. However, this may not be the case, particularly where the strip is constructed of a relatively thin sheet metal. Nevertheless, these stamped-out segments could be used in conjunction with nails or other suitable fasteners to temporarily hold the strips in place against the studs until the strips are permanently secured by means of the nails. Moreover, these segments could be provided in strips 28 of support elements 18 in addition to or in lieu of nails, again depending on the material making up the elements.

What I claim is:

1. A device for supporting sheet material to a vertically extending, fixed support member, said device comprising:

a. a longitudinal metal strip having a front longitudinally extending face and a back longitudinally extending face, said strip being adapted for connection with said support member such that said back face rests against said support member; and b. a plurality of elongated metal support elements spaced from one another longitudinally along the front face of said strip and integrally formed therewith, each of said elements being connected at one end with said strip and extending out beyond the front face thereof, whereby an outwardly extending portion of each of said elements is adapted for insertion through an opening through said sheet material to support said sheet material in a vertical position adjacent said fixed support member said portions being substantially straight before being inserted through association openings, said elements being constructed of bendable metal whereby, once the outwardly extending portion of said elements are inserted through corresponding openings through said sheet material, said portions can be bent in a vertically upward direction to aid in supporting said sheet material against said fixed support member;

c. each of said support elements including an upwardly extending irregularity located a predetermined distance in front of the front face of said elongated strip, said irregularity being positioned directly behind a corresponding opening is said sheet material when the outwardly extending portion of the support element is inserted through said corresponding opening, said irregularity being adapted to inhibit movement of said sheet material inwardly along said support element beyond said irregularity.

2. A device according to claim 1 wherein said elements are stamped-out segments of said strip.

3. A device according to claim 2 including means for at least temporarily connecting said elongated strip to said fixed support member, said connecting means including at least one connecting element which is a stamped-out segment of said strip and which extends out beyond the back longitudinally extending face of said strip, said connecting element tapering to a point as it extends out from said back face.

* * * * *